US009994024B2

(12) United States Patent
Takino et al.

(10) Patent No.: US 9,994,024 B2
(45) Date of Patent: Jun. 12, 2018

(54) LIQUID EJECTING APPARATUS WITH MOVABLE HEAD UNIT

(71) Applicant: SEIKO EPSON CORPORATION, Tokyo (JP)

(72) Inventors: Fumiya Takino, Shiojiri (JP); Eiichiro Watanabe, Matsumoto (JP); Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/432,137

(22) Filed: Feb. 14, 2017

(65) Prior Publication Data

US 2017/0232750 A1 Aug. 17, 2017

(30) Foreign Application Priority Data

Feb. 15, 2016 (JP) ..... 2016-025616

(51) Int. Cl.
*B41J 2/165* (2006.01)
*B41J 25/316* (2006.01)

(52) U.S. Cl.
CPC ..... *B41J 2/16535* (2013.01); *B41J 2/16517* (2013.01); *B41J 2/16538* (2013.01); *B41J 2/16585* (2013.01); *B41J 2/16588* (2013.01); *B41J 25/316* (2013.01)

(58) Field of Classification Search
CPC ..... B41J 2/16535
See application file for complete search history.

(56) References Cited

U.S. PATENT DOCUMENTS

2002/0044168 A1* 4/2002 Hashi ..... B41J 2/16585 347/32
2004/0227784 A1* 11/2004 Lodal ..... B41J 2/16508 347/33
2008/0074484 A1* 3/2008 Sugahara ..... B41J 2/16538 347/102
2009/0147049 A1* 6/2009 Lee ..... B41J 2/1433 347/47

FOREIGN PATENT DOCUMENTS

JP 10-034950 A 2/1998
JP 2014-184645 A 10/2014

* cited by examiner

*Primary Examiner* — Bradley Thies
(74) *Attorney, Agent, or Firm* — Workman Nydegger

(57) ABSTRACT

A liquid ejecting apparatus includes a liquid ejecting head that has a nozzle opening surface in which the nozzles open, a displacing mechanism formed to change a posture of the liquid ejecting head between a first posture in which the nozzle opening surface is inclined with respect to the horizontal and a second posture in which an inclination of the nozzle opening surface is smaller than the inclination of the nozzle opening surface in the first posture, and a wiping member to wipe the liquid ejecting head. On the nozzle opening surface, if a vertical lower end in the first posture is a first end and a vertical upper end in the first posture is a second end, the wiping member wipes the liquid ejecting head from the first end side toward the second end side when the liquid ejecting head is in the second posture.

15 Claims, 5 Drawing Sheets

LIQUID EJECTING APPARATUS WITH MOVABLE HEAD UNIT

BACKGROUND

1. Technical Field

The present invention relates to a liquid ejecting apparatus such as a printer.

2. Related Art

An example of a liquid ejecting apparatus is an ink jet printer that performs a wiping operation for wiping, for example, an ink that has adhered to an ink ejecting section by rubbing the ink ejecting section (a lower surface of a recording head from which the ink is ejected) against a wiping member by rotating the recording head (for example, see JP-A-10-34950).

Waste products such as the ink wiped by the wiping member tend to accumulate on a side surface of the above-mentioned recording head, the side surface intersecting the lower surface with which the wiping member comes into contact. Especially, when the recording head rotates and the lower surface is inclined with respect to the horizontal, the ink accumulated on the side surface at an upper end side of the lower surface may drip down the lower surface toward a lower end, and these droplets may stain recording paper, and the like.

Such a problem is common not only among printers that eject an ink to perform printing, but also among most liquid ejecting apparatuses that have a liquid ejecting section that is arranged facedown, the liquid ejecting section being inclinable with respect to the horizontal.

SUMMARY

An advantage of some aspects of the invention is that there is provided a liquid ejecting apparatus capable of reducing dripping of liquid from a liquid ejecting head that can be inclined with respect to the horizontal.

Hereinafter, an apparatus for solving the above-mentioned problem and its operational advantages will be described. A liquid ejecting apparatus that can solve the above-described problem includes a liquid ejecting head that has nozzles to eject a liquid and a nozzle opening surface in which the nozzles open, a displacing mechanism to change a posture of the liquid ejecting head between a first posture in which the nozzle opening surface is inclined with respect to the horizontal and a second posture in which an inclination of the nozzle opening surface with respect to the horizontal is smaller than the inclination of the nozzle opening surface with respect to the horizontal in the first posture, and a wiping member to wipe the liquid ejecting head. On the nozzle opening surface, if a vertical lower end in the first posture is a first end and a vertical upper end in the first posture is a second end, the wiping member wipes the liquid ejecting head from the first end side toward the second end side when the liquid ejecting head is in the second posture.

With this structure, when the nozzle opening surface of the liquid ejecting head is in the first posture in which the nozzle opening surface is inclined with respect to the horizontal, if the liquid that has adhered to the liquid ejecting head flows from the second end on the vertical upper side toward the first end on the vertical lower side, when the liquid ejecting head is in the second posture, the wiping member performs a wiping operation from the first end side toward the second end side, and thereby the liquid that has accumulated on the first end side can be efficiently removed.

Accordingly, dripping of liquid from the liquid ejecting head that changes its inclination with respect to the horizontal can be reduced. The "posture in which an inclination of the nozzle opening surface with respect to the horizontal is smaller than an inclination of the nozzle opening surface with respect to the horizontal in the first posture" includes a posture in which the nozzle opening surface is positioned in a horizontal position.

In the liquid ejecting apparatus, the displacing mechanism may rotate the liquid ejecting head to change the posture of the liquid ejecting head between the first posture and the second posture. With this structure, the displacing mechanism can smoothly change the posture of the liquid ejecting head by rotating the liquid ejecting head.

In this liquid ejecting apparatus, the liquid ejecting head may have a groove that extends along an outer edge of the nozzle opening surface. With this structure, when the liquid ejecting head is in the first posture, a liquid flows from the second end on the vertical upper side toward the first end on the vertical lower side along the groove that is provided on the nozzle opening surface of the liquid ejecting head, the groove extending along the outer edge. Accordingly, while the liquid that has adhered to the liquid ejecting head in the first posture can be prevented from flowing and entering the nozzles, the liquid that flows along the inclination is allowed to collect at the first end side.

In this liquid ejecting apparatus, the posture of the liquid ejecting head may be changed from the first posture to the second posture at a speed higher than a speed at which the posture of the liquid ejecting head is changed from the second posture to the first posture.

With this structure, the inertial force generated when the liquid ejecting head is quickly moved from the first posture to the second posture and stopped causes a liquid that has adhered to the liquid ejecting head to flow toward the first end side and collect at the first end side. When the posture of the liquid ejecting head is changed from the second posture to the first posture, the speed of the posture change may be reduced to prevent the liquid that has adhered to the liquid ejecting head from flowing from the first end side toward the second end side.

In this liquid ejecting apparatus, after the displacing mechanism changes the posture of the liquid ejecting head from the first posture to the second posture, the wiping member may wipe the liquid ejecting head. With this structure, when the displacing mechanism changes the posture of the liquid ejecting head from the first posture to the second posture and stops the liquid ejecting head, the liquid that has adhered to the liquid ejecting head flows toward the first end side as a result of the inertial force. After this operation, the wiping member may perform a wiping operation, and thereby the liquid that has collected at the first end side of the liquid ejecting head can be efficiently removed.

In this liquid ejecting apparatus, to perform a recording process, the liquid ejecting head may eject a liquid onto a medium that is transported in a transport direction. The liquid ejecting head configures a line head that has the nozzles arranged such that a recording region extends over the entire medium in the width direction, which intersects the transport direction.

With this structure, the liquid ejecting head, which configures a line head, has a plurality of nozzles that are arranged such that a recording region extends over the entire medium, and this structure enables the liquid ejecting head to eject the liquid onto the medium that is transported in the transport direction when the medium is stationary. If the medium is moved during a liquid ejecting operation, the medium comes into contact with the liquid ejecting head more easily than when the medium is stationary during the liquid ejecting operation. Accordingly, if waste products such as a liquid adheres to the liquid ejecting head, the medium coming into contact with the liquid ejecting head may result in smearing. In this regard, the liquid ejecting head that is sufficiently wiped by the wiping member can reduce smearing due to the liquid ejecting head coming into contact with the moving medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid ejecting apparatus according to an embodiment will be described with reference to the attached drawings. The liquid ejecting apparatus is, for example, an ink jet printer that performs recording (printing) by ejecting an ink, which is an example liquid, onto a medium such as paper. In the description below, the direction of gravity Z denotes a vertically downward direction, and the first direction X and the second direction Y denote directions which are orthogonal to each other in horizontal directions.

Figure 1:
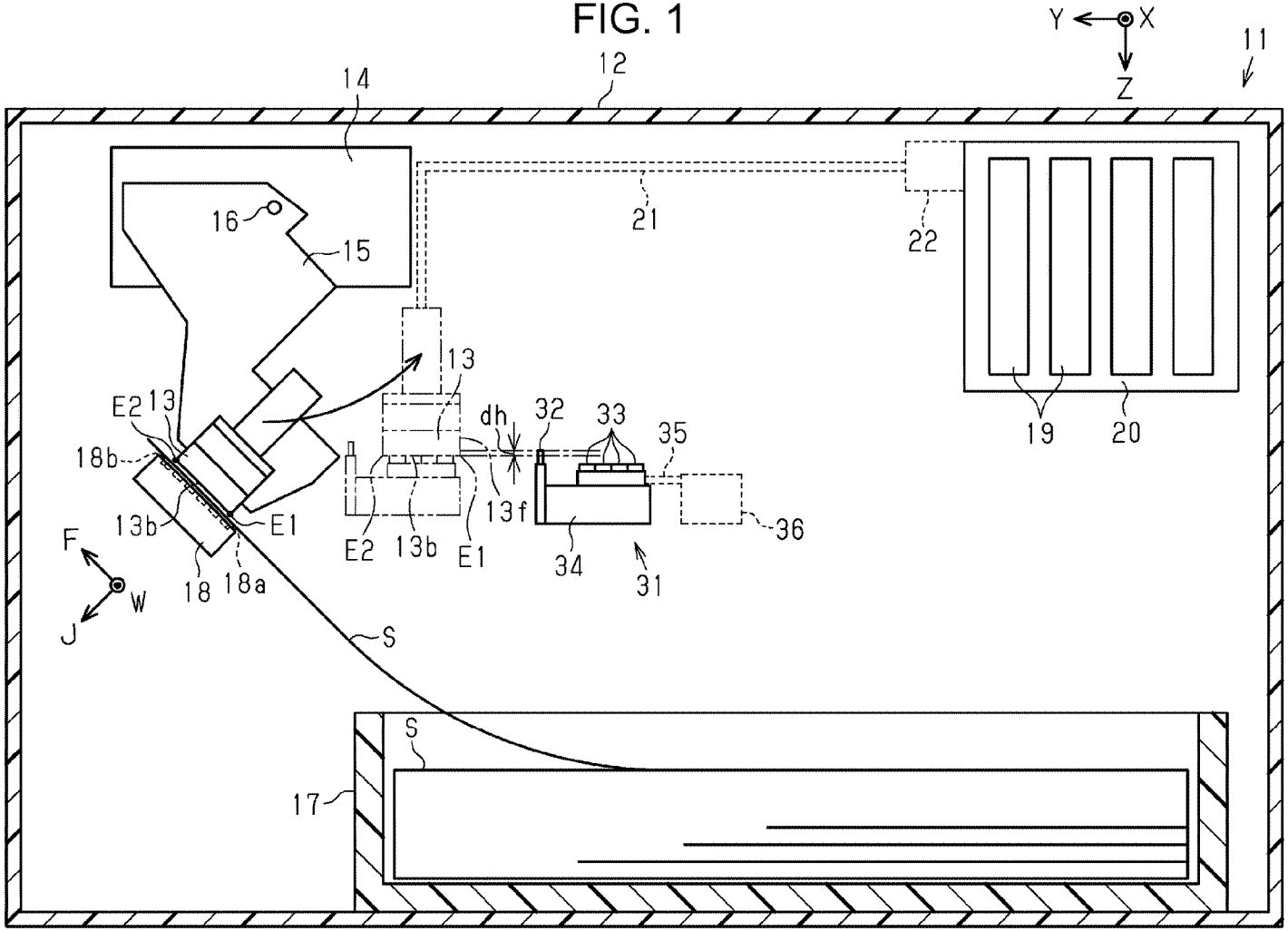
FIG. 1 is a cross-sectional view schematically illustrating a structure of a liquid ejecting apparatus according to an embodiment of the invention.

As illustrated in FIG. 1, a liquid ejecting apparatus 11 includes a casing 12, a liquid ejecting head 13 that ejects a liquid in the casing 12, a maintenance device 31 that performs maintenance of the liquid ejecting head 13, a displacing mechanism 14 that changes the posture of the liquid ejecting head 13, a cassette 17 that store a plurality of media S, and a supporting base 18 that supports the medium S fed from the cassette 17.

An attachment section 20, to which one or more liquid containers 19 that each store a liquid to be supplied to the liquid ejecting head 13 are attached, is provided inside or outside the casing. The liquid ejecting apparatus 11 also includes a liquid supply path 21 that supplies a liquid to the liquid ejecting head 13 and a pressurizing mechanism 22 that applies pressure to a liquid. The pressurizing mechanism 22 applies pressure to the liquid stored in the liquid container 19 to supply the liquid to the liquid ejecting head 13 via the liquid supply path 21. The pressurizing mechanism 22 may be a mechanism that applies pressure directly to a liquid along the liquid supply path 21.

The displacing mechanism 14 includes a holding member 15 that holds the liquid ejecting head 13. The displacing mechanism 14 rotates the holding member 15 around a rotating shaft 16 as indicated by the arrow to change a posture of the liquid ejecting head 13 between a first posture indicated by the solid lines in FIG. 1 and a second posture indicated by the chain double-dashed lines in FIG. 1. The liquid ejecting head 13 includes a nozzle opening surface 13*b* that faces vertically downward in the second posture.

In the first posture, the nozzle opening surface 13*b* of the liquid ejecting head 13 is inclined with respect to the horizontal. An inclination of the nozzle opening surface 13*b* with respect to the horizontal in the second posture is smaller than an inclination of the nozzle opening surface 13*b* with respect to the horizontal in the first posture. In this embodiment, in the second posture, the nozzle opening surface 13*b* of the liquid ejecting head 13 is positioned in a horizontal position in the second posture, however, it is not always necessary that the nozzle opening surface 13*b* be positioned in a horizontal position, and alternatively, the nozzle opening surface 13*b* may be positioned at a position closer to a horizontal position compared with a position in the first posture. In other words, "an inclination of the nozzle opening surface 13*b* with respect to the horizontal is smaller than an inclination of the nozzle opening surface 13*b* with respect to the horizontal in the first posture" includes a case where an inclination of the nozzle opening surface 13*b* with respect to the horizontal is zero and the nozzle opening surface 13*b* is positioned in a horizontal position.

To perform a recording process, the liquid ejecting head 13 that is in the first posture ejects droplets of liquid onto a medium S that is supported by the supporting base 18. In this embodiment, a transport direction F is a direction in which a medium S is advanced on the supporting base 18, and an ejecting direction J is a direction in which a liquid is ejected from the liquid ejecting head 13 that is in the first posture. Width direction W is a direction which intersects the transport direction F and the ejecting direction J.

The maintenance device 31 includes a wiping member 32 that wipes the liquid ejecting head 13, a cap 33 that forms a closed space with the liquid ejecting head 13, a moving mechanism 34 that holds and moves the wiping member 32 and the cap 33, a suction tube 35 that is connected to the cap 33, and a suction mechanism 36 that sucks the space enclosed by the cap 33 through a suction tube 35. The maintenance device 31 performs various maintenance operations when the liquid ejecting head 13 is in the second posture.

The moving mechanism 34 moves the cap 33 between a retracted position indicated by the solid lines in FIG. 1 and a capping position indicated by the chain double-dashed lines in FIG. 1. The capping position is a position where the cap 33 forms a closed space with the nozzle opening surface 13*b* of the liquid ejecting head 13. When the liquid ejecting head 13 is in the second posture and the cap 33 moves to the capping position, a capping operation is performed to suppress drying of the liquid ejecting head 13.

In the state where the capping operation is being performed, the suction mechanism 36 is activated and thereby a negative pressure is produced in the closed space. With this negative pressure, the liquid in the liquid ejecting head 13 is discharged as a waste liquid, and thereby suction cleaning is performed. It should be noted that a cap for suppressing drying of the liquid ejecting head 13 and a cap for suction cleaning may be separately provided. Furthermore, as a cleaning process, a pressure cleaning process may be performed such that pressure is applied by the pressurizing mechanism 22 to discharge a liquid from the liquid ejecting head 13.

The moving mechanism 34 moves the wiping member 32 from a position (initial position indicated by the solid lines in FIG. 1) distant from the liquid ejecting head 13, which is in the second posture in a wiping direction (the second direction Y in this embodiment), and the wiping member 32 comes into contact with the nozzle opening surface 13*b* of the liquid ejecting head 13. On the nozzle opening surface 13*b*, if a vertical lower end in the first posture is a first end E1 and a vertical upper end in the first posture is a second end E2, the wiping member 32 wipes the liquid ejecting head 13 from the first end E1 side toward the second end E2 side by moving in the wiping direction when the liquid ejecting head 13 is in the second posture. The maintenance operation in which the liquid ejecting head 13 is wiped by the member 32 is referred to as wiping.

It is preferable that the wiping member 32 be formed of an elastic deformable plate member such as a rubber member or an elastomer member. In such a case, in order to wipe the liquid ejecting head 13 by using the wiping member 32, the wiping member 32 is arranged to come into contact with the nozzle opening surface 13*b* at a portion of a predetermined length dh on a tip side of the wiping member 32 so that the wiping member 32 elastically deforms to rub the nozzle opening surface 13*b* to remove waste products that have adhered to the nozzle opening surface 13*b*. Furthermore, such an arrangement of the wiping member 32 and the nozzle opening surface 13*b* that enables the wiping member 32 and the nozzle opening surface 13*b* to come into contact with each other enables the liquid ejecting head 13 to be wiped by the wiping member 32 on a side surface 13*f* on the first end E1 side, the side surface 13*f* extending in a direction intersecting the nozzle opening surface 13*b*.

During a wiping operation, when the elastically deformed wiping member 32 is separated from the liquid ejecting head 13, waste products may be dispersed. Consequently, it is preferable that no transport path of the medium S be disposed under the liquid ejecting head 13 that is in the second posture. If the transport path of the medium S is disposed below the liquid ejecting head 13 that is in the second posture, it is preferable that a barrier that prevents the scattering of liquid or the like be disposed between the maintenance device 31 and the transport path.

It is preferable that a wiping operation be performed when waste products such as a liquid adhere to the liquid ejecting head 13. For example, a liquid discharged from the liquid ejecting head 13 adheres to the nozzle opening surface 13*b* after a suction cleaning operation or a pressure cleaning operation has been performed, and in such a case, it is preferable that a wiping operation be performed. In another case, while the liquid ejecting head 13 is ejecting a liquid onto a medium S, fine mist is produced and adheres to the nozzle opening surface 13*b*, the side surface 13*f*, and the like. As the amount of adhesion increases, the adhering liquid turns into droplets and begins to drip, and these droplets may stain the periphery. To solve the problem, in some cases, when a recording operation is performed for a long time, a wiping operation is performed at a predetermined time during the recording operation to prevent the liquid from dripping.

Furthermore, the liquid ejecting head 13 performs a maintenance operation such as a flushing operation for ejecting and discharging a liquid, for example, when a slight ejection failure occurs or after a wiping operation has been performed, regardless of the recording process. In such a case, a rib 18*a* that supports a medium S and a concave liquid receiving section 18*b* that is disposed around the rib 18*a* may be provided to perform flushing toward the liquid receiving section 18*b* when there is no medium S on the supporting base 18 (see FIG. 4).

The liquid receiving section 18*b* on the supporting base 18 enables the liquid ejecting head 13 that is in the first posture to perform flushing without changing the posture between transport of a medium S and transport of the next medium S (between paper sheets), for example, when a recording operation is performed on a plurality of sheets of the medium S. Since the posture of the liquid ejecting head 13 is not changed, the time necessary for the maintenance operation can be reduced compared to a case where the posture of the liquid ejecting head 13 is changed to the second posture in the middle of a recording operation in which flushing is performed toward a liquid receiving section such as the cap 33.

Figure 2:
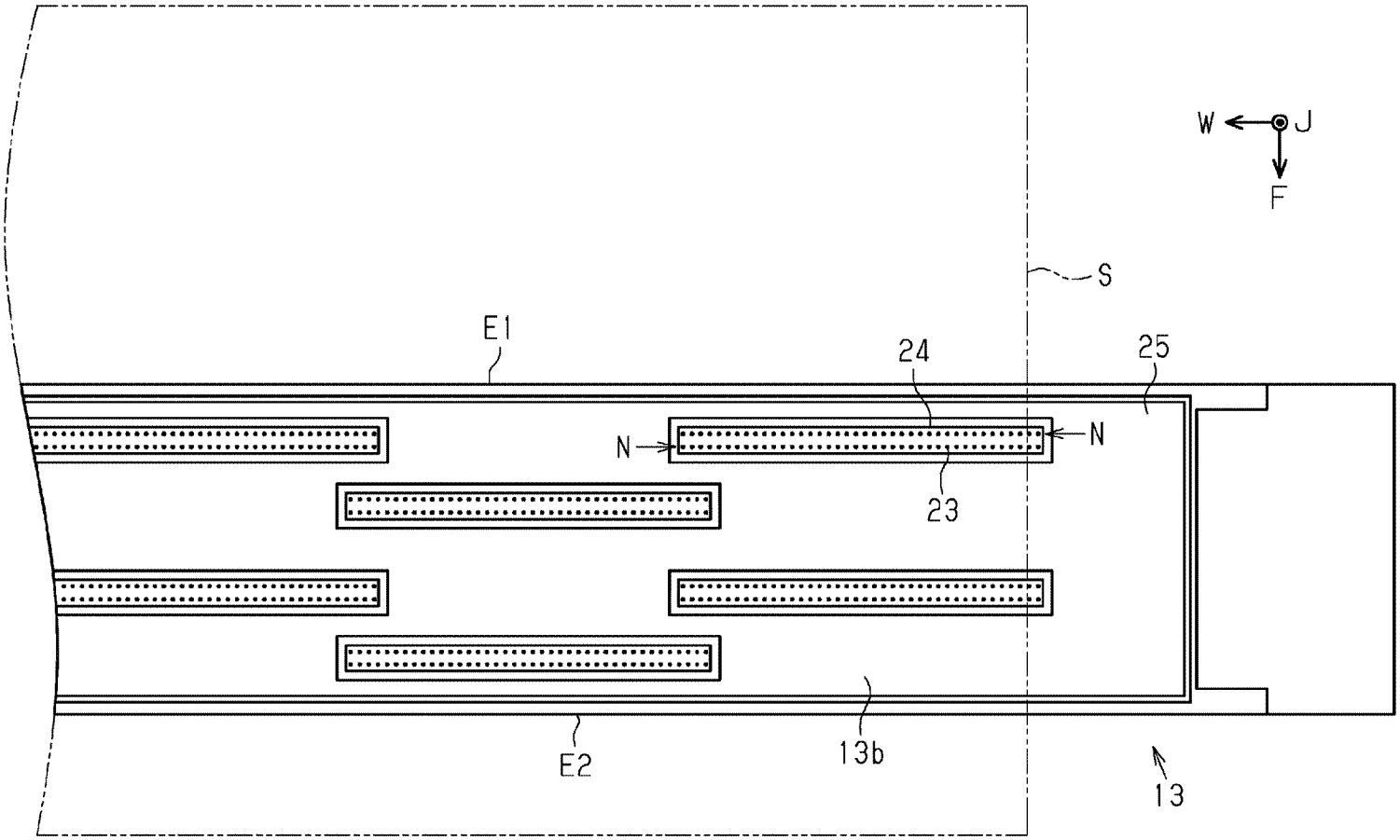
FIG. 2 is a bottom view of a liquid ejecting head provided in the liquid ejecting apparatus in FIG. 1.

The liquid ejecting head 13 includes a plurality of nozzles 23 that eject a liquid in the ejecting direction J as illustrated in FIG. 2. The nozzles 23 are aligned to form a line head such that the nozzles 23 of the liquid ejecting head 13 according to the embodiment can cover a recording region that extends over the entire medium S in the width direction W, which intersects the transport direction F.

Figure 3:
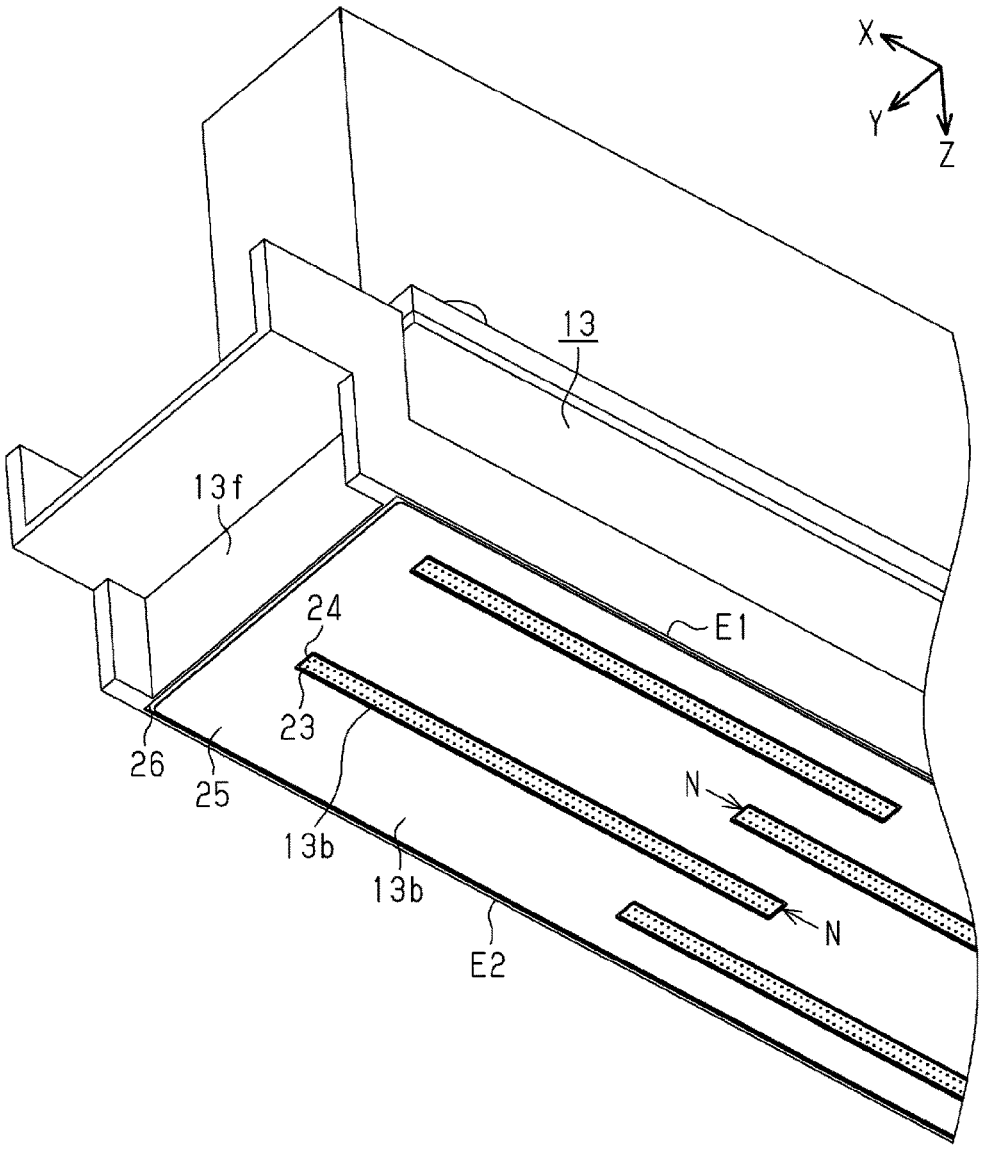
FIG. 3 is a perspective view of the liquid ejecting head in FIG. 2.

As illustrated in FIG. 3, the liquid ejecting head 13 includes a nozzle plate 24 that has the nozzles 23, and a protection member 25 that has openings that enable the nozzles 23 to be exposed, the protection member 25 protruding from the nozzle plate 24 in the ejecting direction J. In this embodiment, the nozzles 23 are aligned in the lengthwise direction of the liquid ejecting head 13 to form a nozzle array N, and one or more (in this embodiment, two) nozzle arrays N form a nozzle group. A plurality of openings are provided on the protection member 25 for the respective nozzle groups.

In this embodiment, the nozzle opening surface 13*b* in which the nozzles 23 open includes the lower surface of the nozzle plate 24 in which the nozzles 23 open and the lower surface of the protection member 25. It is preferable that the liquid ejecting head 13 include a groove 26 that extends along an outer edge of the nozzle opening surface 13*b* such that the groove 26 surrounds the area the nozzles 23 open.

Figure 4:
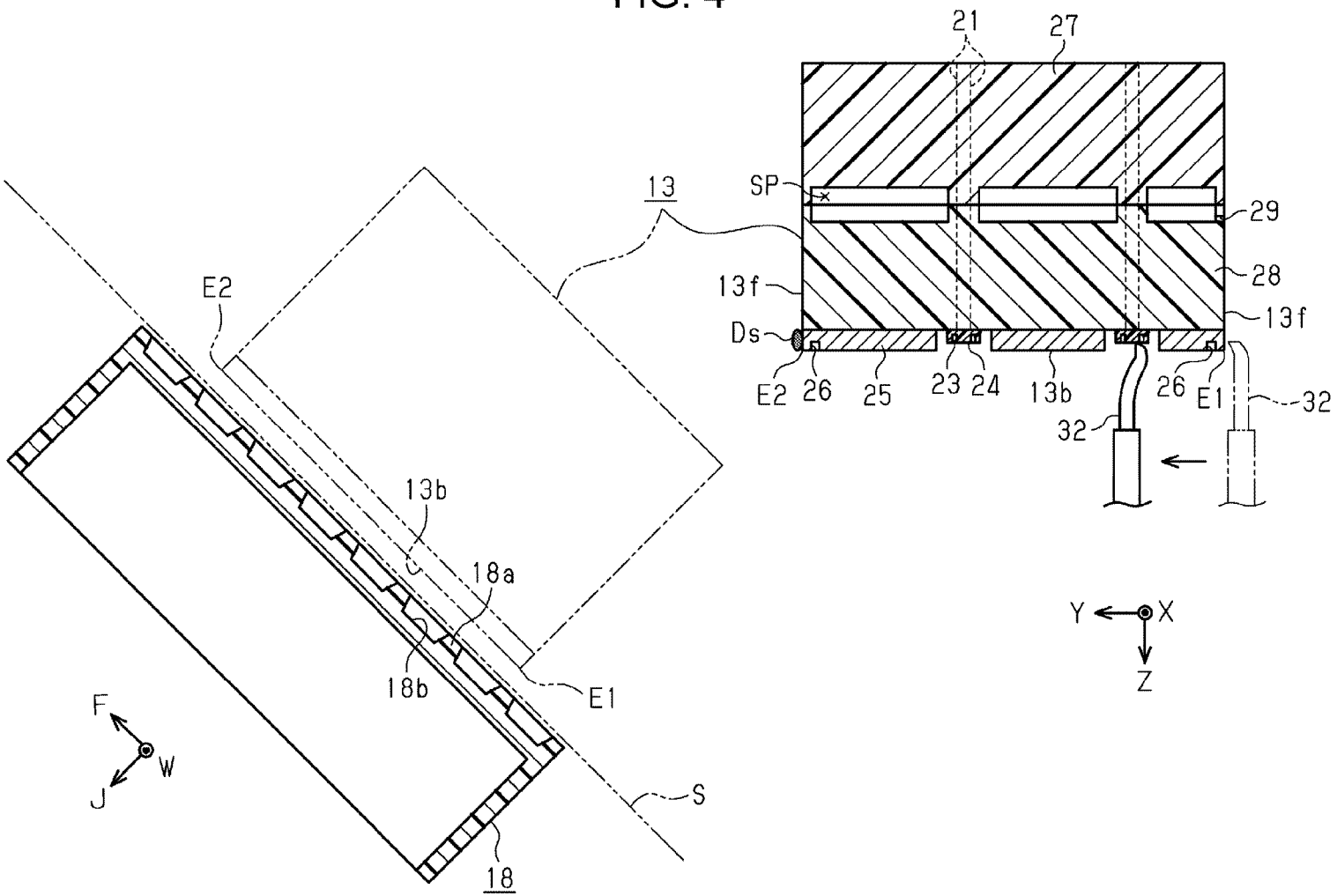
FIG. 4 is a cross-sectional view schematically illustrating a structure of the liquid ejecting head in FIG. 2.

As illustrated in FIG. 4, although the protection member 25 causes a difference in the level between the lower surface of the nozzle plate 24 in which the nozzles 23 open and the lower surface of the protection member 25, the wiping member 32 moves over the portion with a level difference and wipes the nozzle opening surface 13*b*.

If a liquid supply path 21 that supplies a liquid to the liquid ejecting head 13 is formed across an upstream side member 27 and a downstream side member 28, which are different members, and a space SP exists between the upstream side member 27 and the downstream side member 28, the liquid may leak from the joint between the upstream side member 27 and the downstream side member 28 and remain in the space SP.

To solve the problem, it is preferable that a through hole 29 that enables the space SP, which surrounds the joint between the upstream side member 27 and the downstream side member 28, to communicate with the outside be provided to enable the liquid that has leaked from the joint to be discharged via the through hole 29. In such a case, the through hole 29 is open to the side surface 13*f* of the liquid ejecting head 13 on the first end E1 side that is a vertical lower end when the liquid ejecting head 13 is in the first posture as indicated by the chain double-dashed lines in FIG. 4. With this structure, when the liquid ejecting head 13 is in the first posture, the liquid that remains in the space SP can flow from the through hole 29 toward the side surface 13*f*.

Next, operation of the liquid ejecting apparatus 11 that has the above-described structure will be described. The displacing mechanism 14 positions the liquid ejecting head 13 in the first posture indicated by the chain double-dashed lines in FIG. 4 to perform a recording process. The displacing mechanism 14 rotates the liquid ejecting head 13 to change the posture of the liquid ejecting head 13 from the first posture to the second posture indicated by the solid lines in FIG. 4 to perform a suction cleaning operation and a wiping operation as maintenance operations.

The maintenance operations such as a suction cleaning operation, a wiping operation, and a flushing operation may be separately performed. Before or after a recording process is performed, or when an ejection failure occurs, the three maintenance operations may be performed as a set in the order of the suction cleaning operation, the wiping operation, and the flushing operation.

For example, to perform the three maintenance operations as a set after a recording process, first, the posture of the liquid ejecting head 13 is changed from the first posture to the second posture to perform the suction cleaning operation, and then, the wiping operation is performed. After the wiping operation is performed, the liquid ejecting head 13 performs the flashing operation. The flushing operation may be performed with flushing toward the cap 33 in the second posture without any change in the posture or may be performed with flushing toward the liquid receiving section 18*b* of the supporting base 18 by changing the posture of the liquid ejecting head 13 from the second posture to the first posture.

To sequentially perform the suction cleaning operation and the wiping operation, after performing the suction cleaning operation and before performing the wiping operation, the liquid ejecting head 13 may be reciprocated once or a plurality of times between the second posture and the first posture. The rotation of the liquid ejecting head 13 to reciprocate the liquid ejecting head 13 enables the liquid adhering to the liquid ejecting head 13 to flow from the second end E2 side, which corresponds to the vertical upper end, toward the first end E1 side, which corresponds to the vertical lower end, and collect at the first end E1 side by the inertial force that is generated when the liquid ejecting head 13 is moved from the second posture to the first posture, moved from the first posture to the second posture, and stopped in the second posture. In this state, the wiping member 32 wipes the liquid ejecting head 13 from the first end E1 side toward the second end E2 side, and thereby the liquid adhering to the liquid ejecting head 13 can be effectively removed.

In such a case, the posture of the liquid ejecting head 13 may be changed from the first posture to the second posture in the reverse position of a reciprocation movement at a speed higher than a speed when the posture of the liquid ejecting head 13 is changed from the second posture to the first posture in the forward position of the reciprocation movement. This speed change prevents the liquid from flowing when the posture of the liquid ejecting head 13 is changed from the second posture to the first posture and enables the liquid to flow toward the first end E1 side by increasing the inertial force that is generated when the liquid ejecting head 13 is stopped in the second posture when the liquid ejecting head 13 returns to the second posture from the first posture.

The liquid adhering to the side surface 13*f* on the first end E1 side is scraped by the wiping member 32 when the wiping member 32 performs a wiping operation on the liquid ejecting head 13 from the first end E1 side toward the second end E2 side. On the other hand, since the wiping member 32 hardly reaches the side surface 13*f* on the second end E2 side, waste products Ds tend to remain as illustrated in FIG. 4.

If the liquid ejecting head 13 that is in the first posture continues performing the recording process while the waste products Ds containing the liquid adhere to the side surface 13*f* on the second end E2 side, the waste products Ds may enter the nozzles 23 while the Ds flows from the second end E2 side, which is the vertical upper end, toward the first end E1 side, which is the vertical lower end, and this may result in an ejection failure.

However, the groove 26 that is provided along the outer edge of the nozzle opening surface 13*b* can reduce the liquid from entering the nozzles 23 since the liquid flows along the groove 26 when the liquid flows from a plurality of (in this embodiment, four) side surfaces 13*f* including the side surface 13*f* on the second end E2 side toward the nozzle opening surface 13*b* in a state where the liquid ejecting head 13 is in the first posture. Furthermore, by collecting the liquid along the groove 26, the liquid can readily flow toward the lower end side.

It is preferable that a liquid repellent film be provided on the lower surface (the surface in which the nozzles 23 open) of the nozzle plate 24 to increase the liquid repellency compared to the lower surface of the protection member 25 that forms the nozzle opening surface 13*b*. The higher liquid repellency of the nozzle plate 24 enables the liquid to flow toward the first end E1 side without remaining on the lower surface of the nozzle plate 24 when the liquid flows along the nozzle opening surface 13*b*.

According to the above-described embodiments, the following advantages can be achieved.

(1) In some cases, a liquid that has adhered to the liquid ejecting head 13 may flow from the second end E2 on the vertical upper side toward the first end E1 on the vertical lower side when the nozzle opening surface 13*b* of the liquid ejecting head 13 is in the first posture, the first posture being inclined with respect to the horizontal. In such a case, when the liquid ejecting head 13 is in the second posture, the wiping member 32 performs a wiping operation from the first end E1 side toward the second end E2 side, and thereby the liquid that has accumulated on the first end E1 side can be efficiently removed. Accordingly, dripping of liquid from the liquid ejecting head 13 that changes its inclination with respect to the horizontal can be reduced.

(2) The displacing mechanism 14 can smoothly change a posture of the liquid ejecting head 13 by rotating the liquid ejecting head 13. Furthermore, the liquid ejecting head 13 can be moved between the position where the nozzle opening surface 13*b* faces the supporting base 18 and the position where the nozzle opening surface 13*b* faces the maintenance device 31 while the movement amount of the liquid ejecting head 13 can be suppressed by the rotating shaft 16 disposed at a location different to that of the nozzle opening surface 13*b*.

(3) When the liquid ejecting head 13 is in the first posture, a liquid flows from the second end E2 on the vertical upper side toward the first end E1 on the vertical lower side along the groove 26 that is provided on the nozzle opening surface 13*b* of the liquid ejecting head 13, the groove 26 extending along the outer edge. Accordingly, while the liquid that has adhered to the liquid ejecting head 13 that is in the first posture can be prevented from flowing and entering the nozzles 23, the liquid that flows along the inclination can be collected at the first end E1 side.

(4) The inertial force generated when the liquid ejecting head 13 is quickly moved from the first posture to the second posture and stopped causes a liquid that has adhered to the liquid ejecting head 13 to flow toward the first end side E1 and collect at the first end side E1. When the posture of the liquid ejecting head 13 is changed from the second posture to the first posture, the speed of the posture change may be reduced to prevent the liquid that has adhered to the liquid ejecting head 13 from flowing from the first end E1 side toward the second end E2 side.

(5) When the displacing mechanism 14 changes the posture of the liquid ejecting head 13 from the first posture to the second posture and the liquid ejecting head 13 is stopped, the liquid that has adhered to the liquid ejecting head 13 flows toward the first end side as a result of the inertial force. After this operation, the wiping member 32 may perform a wiping operation, and thereby the liquid that has collected at the first end side E1 of the liquid ejecting head 13 can be efficiently removed.

(6) The liquid ejecting head 13, which configures the line head, has the plurality of nozzles 23 that are arranged such that the recording region extends over the entire medium S, and this structure enables the liquid ejecting head 13 to eject a liquid onto the medium S that is transported in the transport direction F when the medium S is stationary. If the medium S is being moved during a liquid ejecting operation, the medium S comes into contact with the liquid ejecting head 13 more easily than when the medium S is stationary during the liquid ejecting operation. Accordingly, if waste products such as a liquid adheres to the liquid ejecting head 13, the medium S coming into contact with the liquid ejecting head 13 may result in smearing. In this regard, the liquid ejecting head 13 that is sufficiently wiped by the wiping member 32 can reduce smearing due to the liquid ejecting head 13 coming into contact with the moving medium S.

The above-described embodiments may be modified as modifications described below. The above-described embodiments and the following modifications may be combined in any combination.

The liquid ejecting head 13 may omit the protection member 25.

The nozzles 23 on the liquid ejecting head 13 may be provided not in a nozzle array N but in a random arrangement such that a recording range covers the entire medium S. Alternatively, the nozzles 23 may be provided not as a nozzle group but as a long nozzle array N such that a recording range covers the entire medium S.

The cap 33 may be provided, with respect to the moving direction in a wiping operation by the wiping member 32, on the front side of the wiping member 32 in the moving direction, or on the back side of the wiping member 32 in the moving direction. The cap 33 disposed on the front side of the wiping member 32 in the moving direction may elastically deform due to the wiping member 32 that separates from the liquid ejecting head 13 at the end of the wiping operation, and the liquid may spread toward the front side in the moving direction, and in such a case, the spread liquid can be received by the cap 33. On the other hand, if the cap 33 is disposed on the back side of the wiping member 32 in the moving direction as illustrated in FIG. 1, after the wiping member 32 moves and a wiping operation is performed, a flushing operation can be immediately performed to the cap 33, or a capping may be performed.

The maintenance device 31 may separately include a moving mechanism that moves the wiping member 32 and a moving mechanism that moves the cap 33. It is preferable that the structure in which a single moving mechanism 34 moves the wiping member 32 and the cap 33 as in the above-described embodiment be used to simplify the structure of the maintenance device 31.

In addition to the entire wiping operation for wiping the entire nozzle opening surface 13*b* from the first end E1 toward the second end E2 by the wiping member 32, a partial wiping operation for wiping waste products that have adhered to the side surface 13*f* of the wiping member 32 on the first end E1 side may be performed. The partial wiping operation ends before the wiping member 32 reaches the nozzle 23. The partial wiping rarely causes an ejection failure due to the waste products that are removed from the side surface 13*f* and the like and enter the nozzles 23. It is preferable that the wiping member 32 be composed of a member that can absorb a liquid, for example, a cloth or a sponge for the partial wiping because such a member leaves few waste products on the nozzle opening surface 13*b* at the end of the wiping.

Such a wiping member for the partial wiping may be provided separately from the wiping member 32 for the entire wiping. For example, the wiping member for the partial wiping may be an elastically deformable plate-like member, and the wiping member 32 for the entire wiping may be a member that can absorb a liquid, for example, a cloth or a sponge. Furthermore, it is preferable that an entire wiping operation be performed by using the wiping member 32 that can absorb a liquid after a partial wiping operation has been performed by using a plate-like member because such a member leaves few waste products on the nozzle opening surface 13*b* at the end of the wiping.

The wiping member 32 may wipe the nozzle opening surface 13*b* after the wiping member 32 has wiped the nozzle opening surface 13*b* in a forward movement from the first end E1 toward the second end E2, also in a backward movement from the second end E2 toward the first end E1.

Figure 5:
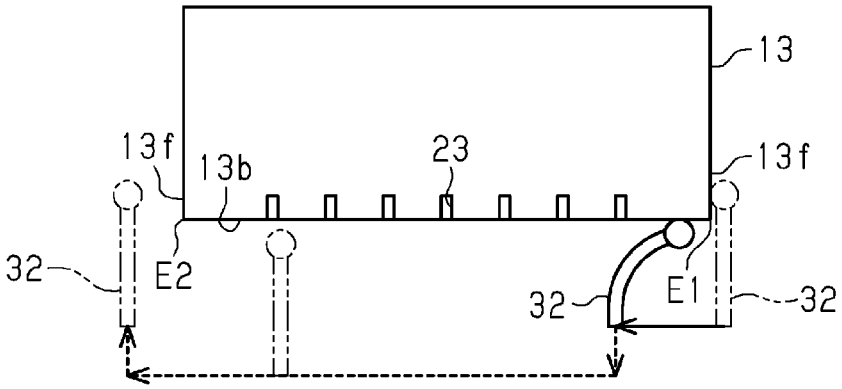
FIG. 5 is a schematic view of a modification of a wiping member provided in the liquid ejecting apparatus in FIG. 1.
Figure 6:
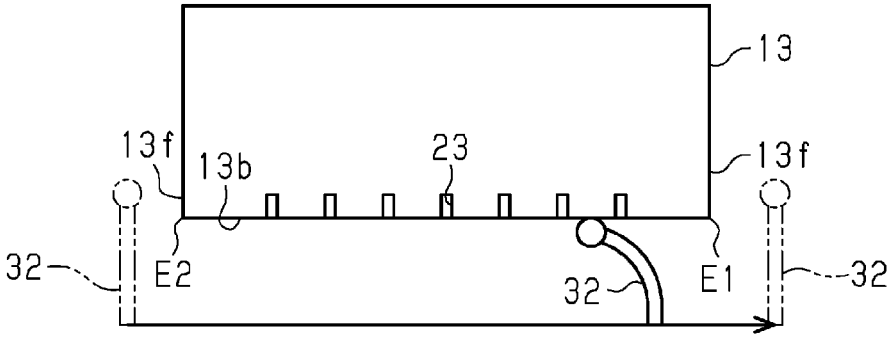
FIG. 6 is a schematic view illustrating an operation of the wiping member in FIG. 5 wiping a nozzle opening surface.

As shown in a modification illustrated in FIG. 5 and FIG. 6, the wiping member 32 may wipe the nozzle opening surface 13*b* after the wiping member 32 has wiped the side surface 13*f* on the first end E1 side in a forward movement from the first end E1 toward the second end E2, also in a backward movement from the second end E2 toward the first end E1. In such a case, as indicated by the arrow of the solid line in FIG. 5, after the wiping member 32 has moved to wipe the side surface 13*f*, the wiping member 32 may separate from the nozzle opening surface 13*b* and move to a position passed through the second end E2 as indicated by the arrow of the broken lines in FIG. 5. Then, the wiping member 32 moves backward and wipes the entire nozzle opening surface 13*b* from the second end E2 to the first end E1 as indicated by the solid line in FIG. 6.

It is preferable that, after the wiping member 32 has wiped the side surface 13*f*, the wiping member 32 separate from the nozzle opening surface 13*b* before the wiping member 32 reaches the nozzles 23 on the nozzle opening surface 13*b* because the wiping member 32 is prevented from pressing waste products and the like that have adhered to the liquid ejecting head 13 and prevented from enabling the waste products to enter the nozzles 23 as illustrated in FIG. 5.

Figure 7:
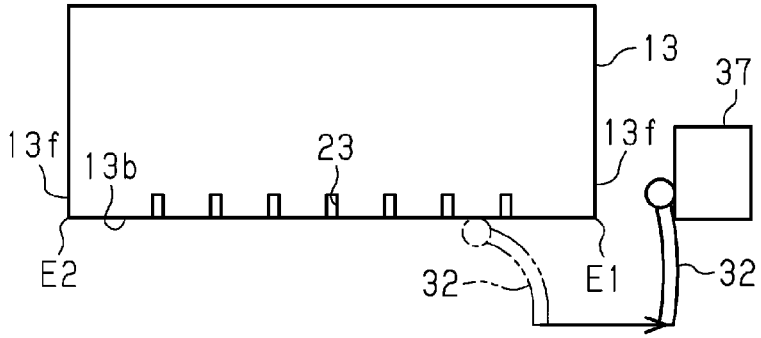
FIG. 7 is a schematic view illustrating the wiping member according to the modification illustrated in FIG. 5, the wiping member coming into contact with a cleaning member.

A cleaning member 37 that removes waste products that have adhered to the wiping member 32 may be provided as illustrated in FIG. 7. For example, the cleaning member 37 that is disposed at the end of the travel path of the wiping member 32 comes into contact with the wiping member 32 at the end of the movement for the wiping, and this operation enables waste products that have adhered to the wiping member 32 to move to the cleaning member 37. In such a case, it is preferable that the cleaning member 37 be composed of a material that can absorb a liquid to immediately absorb a liquid that has adhered to the wiping member 32. The cleaning member 37 may be disposed at the end of the forward travel path and at the end of the backward travel path to perform wiping operations by the wiping member 32 both in the forward travel path and the backward travel path.

The nozzle opening surface 13*b* of the liquid ejecting head 13 may be substantially vertically inclined with respect to the horizontal in the first posture.

The liquid ejecting head 13 may eject a liquid while reciprocating in the width direction W, which intersects the direction F for transporting the medium S, to perform a recording process.

The liquid ejecting head 13 may perform a recording process in the second posture and perform a maintenance operation in the first posture.

A liquid that is ejected by the liquid ejecting head 13 is not limited to an ink, and alternatively, the liquid may be, for example, a fluid that contains particles of a functional material dispersed or mixed in a liquid. For example, a liquid material containing a dispersed or dissolved material such as an electrode material or a color material (pixel material) used for manufacturing liquid crystal displays, electroluminescence (EL) displays, or field emission displays may be ejected for recording.

It should be noted that the medium S is not limited to paper, and alternatively, for example, plastic films, thin plate materials, or cloths used in printing apparatuses may be used.

The entire disclosure of Japanese Patent Application No. 2016-025616, filed Feb. 15, 2016 is expressly incorporated by reference herein.

What is claimed is:

1. A liquid ejecting apparatus comprising:

a liquid ejecting head that has nozzles configured to eject a liquid and a nozzle opening surface in which the nozzles open;

a displacing mechanism configured to change a posture of the liquid ejecting head between a first posture in which the nozzle opening surface is inclined with respect to the horizontal and a second posture in which an inclination of the nozzle opening surface with respect to the horizontal is smaller than the inclination of the nozzle opening surface with respect to the horizontal in the first posture; and a wiping member configured to wipe the liquid ejecting head, wherein while the displacing mechanism changes a posture of the liquid ejecting head from the first posture to the second posture, the wiping member is disposed at a position that does not vertically overlap with an area through which the liquid ejecting head passes, wherein, on the nozzle opening surface, if a vertical lower end in the first posture is a first end and a vertical upper end in the first posture is a second end, the wiping member wipes the liquid ejecting head from the first end side toward the second end side in a state where the liquid ejecting head is stopped in the second posture.

2. The liquid ejecting apparatus according to claim 1, wherein the displacing mechanism rotates the liquid ejecting head to change the posture of the liquid ejecting head between the first posture and the second posture.

3. The liquid ejecting apparatus according to claim 1, wherein the liquid ejecting head has a groove that extends along an outer edge of the nozzle opening surface.

4. The liquid ejecting apparatus according to claim 1, wherein the posture of the liquid ejecting head is changed from the first posture to the second posture at a speed higher than a speed at which the posture of the liquid ejecting head is changed from the second posture to the first posture.

5. The liquid ejecting apparatus according to claim 1, wherein after the displacing mechanism has changed a posture of the liquid ejecting head from the first posture to the second posture, the wiping member wipes the liquid ejecting head.

6. The liquid ejecting apparatus according to claim 1, wherein the liquid ejecting head ejects a liquid onto a medium that is transported in a transport direction to perform a recording process, and the liquid ejecting head configures a line head that has the nozzles arranged such that a recording region extends over the entire medium in the width direction, which intersects the transport direction.

7. The liquid ejecting apparatus according to claim 1, further comprising:

a cap member configured to form a closed space between the cap member and the liquid ejecting head, wherein the second posture is a posture in which the nozzle opening surface can face the cap member.

8. The liquid ejecting apparatus according to claim 1, wherein the liquid ejecting head has a groove that extends along an outer edge of the nozzle opening surface, the groove configured to at least partially prevent liquid from flowing onto the nozzle opening surface.

9. The liquid ejecting apparatus according to claim 1, wherein the displacing mechanism includes a holding member that holds the liquid ejecting head and a rotating shaft that causes the holding member to rotate to thereby rotate the liquid ejecting head.

10. The liquid ejecting apparatus according to claim 1, wherein while the displacing mechanism changes a posture of the liquid ejecting head from the first posture to the second posture, the wiping member is disposed at the position closer to the first end of the nozzle opening surface in the second posture than the second end of the nozzle opening surface in the second posture.

11. The liquid ejecting apparatus according to claim 1, further comprising:

a medium supporting portion configured to support a recording medium, the medium supporting portion facing the nozzle opening surface in the first posture, wherein the medium supporting portion includes a liquid receiving portion that receives the liquid ejected from the liquid ejecting head when the medium supporting portion does not support the recording medium.

12. The liquid ejecting apparatus according to claim 1, further comprising:

a cap member configured to form a closed space between the cap member and the liquid ejecting head, wherein the cap member is provided on an upstream side from the wiping member in a direction in which the wiping member wipes the liquid ejecting head.

13. The liquid ejecting apparatus according to claim 1, further comprising:

a cleaning member configured to clean the wiping member, wherein the cleaning member is provided on an downstream side from the liquid ejecting head in a direction in which the wiping member wipes the liquid ejecting head.

14. The liquid ejecting apparatus according to claim 1, further comprising:

a casing; and a cassette member for storing a recording medium, the cassette member and the liquid ejecting head being inside the casing, wherein when the liquid ejecting head is in the second posture, the inclination of the nozzle opening surface is substantially the same as an inclination of the cassette member.

15. The liquid ejecting apparatus according to claim 1, wherein the nozzle opening surface includes a protection member that protrudes from the nozzle opening surface to thereby create a difference in a level surrounding the nozzles.

* * * * *